US008381968B2

(12) United States Patent
Mandreucci et al.

(10) Patent No.: US 8,381,968 B2
(45) Date of Patent: Feb. 26, 2013

(54) CONVERTIBLE FOOD TRAY

(75) Inventors: Marcello Mandreucci, Robbinsville, NJ (US); Andrew DePascale, Hamilton, NJ (US)

(73) Assignee: Convertible Tray LLC, Robbinsville, NJ (US)

( * ) Notice: Subject to any disclaimer, the term of this patent is extended or adjusted under 35 U.S.C. 154(b) by 180 days.

(21) Appl. No.: 12/803,641

(22) Filed: Jul. 1, 2010

(65) Prior Publication Data

US 2012/0000971 A1 Jan. 5, 2012

(51) Int. Cl.
*B65D 5/36* (2006.01)

(52) U.S. Cl. ..... 229/108.1; 229/103; 206/736; 248/150; 108/51.3

(58) Field of Classification Search ..... 229/108.1, 229/103, 902, 122.31, 104, 107, 109; 206/736; 248/150, 344; 108/51.3, 157.14, 118, 121, 108/127, 128
See application file for complete search history.

(56) References Cited

U.S. PATENT DOCUMENTS

| | | | | |
|---|---|---|---|---|
| 2,914,235 | A * | 11/1959 | Jones | 206/511 |
| 5,429,296 | A * | 7/1995 | Southwell et al. | 229/168 |
| 6,036,269 | A * | 3/2000 | Colton | 297/440.12 |
| 2005/0103831 | A1 * | 5/2005 | Doyle | 229/108.1 |
| 2005/0218202 | A1 * | 10/2005 | Braoudakis | 229/178 |

* cited by examiner

*Primary Examiner* — Nathan J Newhouse
*Assistant Examiner* — Christopher Demeree
(74) *Attorney, Agent, or Firm* — Stuart M. Goldstein

(57) ABSTRACT

A food tray is automatically convertible from a flat position to an erect, elevated position. The food tray is fabricated as a blank, preferably of rigid cardboard, which is appropriately folded and, with interlocking tabs, assembled to lay flat under the food, particularly a pizza pie, when the pizza remains in its flat delivery box. When the pizza is to be removed from its box, the central tray section of the convertible food tray is lifted, with the pizza thereon. This permits folded wing sections of the tray located beneath the central section to swing down to become tray leg support members. When the support members of the tray are placed on a table or similar surface, the weight of the pizza on the central section compels the support members inward, to a position perpendicular to the central section, to securely provide elevated support to the pizza on the food tray.

7 Claims, 5 Drawing Sheets

CONVERTIBLE FOOD TRAY

BACKGROUND OF THE INVENTION

Pizza pies are routinely packaged and delivered in the flat cardboard boxes with which most consumers are familiar. A typical box consists of the relatively large, open main container section, two to three inches in depth, in which the pizzas are placed, and large lids which are connected to the container section and serve to enclose the pizzas within the boxes. This type pizza box, used for years, is perfectly suited for safely housing, protecting, transporting, and delivering pizzas. However, the box is not particularly accommodating in the post-delivery process. Once the box's lid is pulled back and the box is opened, access to and retrieval of the pizza itself presents certain annoying challenges. Reaching into the box to lift out a hot pizza presents several obvious problems, as does where to put the pizza once it is removed from the box. If the pizza is left in the box, the box most often remains on the table while individual slices of pizza are awkwardly removed. The size of the box itself, especially when the lid is open, takes up a large amount of space. This usually results in the lid being haphazardly ripped off, causing an unsightly torn box, disruption of the pizza in the box, and loose scattered pieces of ripped cardboard.

SUMMARY OF THE INVENTION

It is thus the object of the present invention to overcome the limitations, disadvantages and challenges presented by the packaging and transporting of flat foods, particularly pizzas, in their boxes or enclosures.

It is the object of the present invention to provide a convertible food tray which can be folded flat and placed within a flat pizza type box in order to support a pizza or similarly shaped hot or cold food item in the box.

It is another object of the present invention to provide a convertible food tray which can be lifted out of a flat pizza type box, with a pizza resting on the tray, and in which leg support members will automatically open to securely support the pizza on the tray in an elevated position.

It is still another object of the present invention to provide a convertible food tray which is very economical to manufacture in mass quantities, but individually very lightweight.

It is a further object of the present invention to provide a convertible food tray which is easy to assemble and readily and quickly positioned in an existing pizza type box.

It is still another object of the present invention to provide a convertible food tray which is extremely simple to use and which is easily disposed of or available for reuse.

These and other objects are accomplished by the present invention, a food tray which is automatically convertible from a flat position to an erect, elevated position. The food tray is fabricated as a blank, preferably of rigid cardboard, which is appropriately folded and, with interlocking tabs, assembled to lay flat under the food, particularly a pizza pie, when the pizza remains in its flat delivery box. When the pizza is to be removed from its box, the central tray section of the convertible food tray is lifted, with the pizza thereon. This permits folded wing sections of the tray located beneath the central section to swing down to become tray leg support members. When the support members of the tray are placed on a table or similar surface, the weight of the pizza on the central section compels the support members inward, to a position perpendicular to the central section, to securely provide elevated support to the pizza on the food tray.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
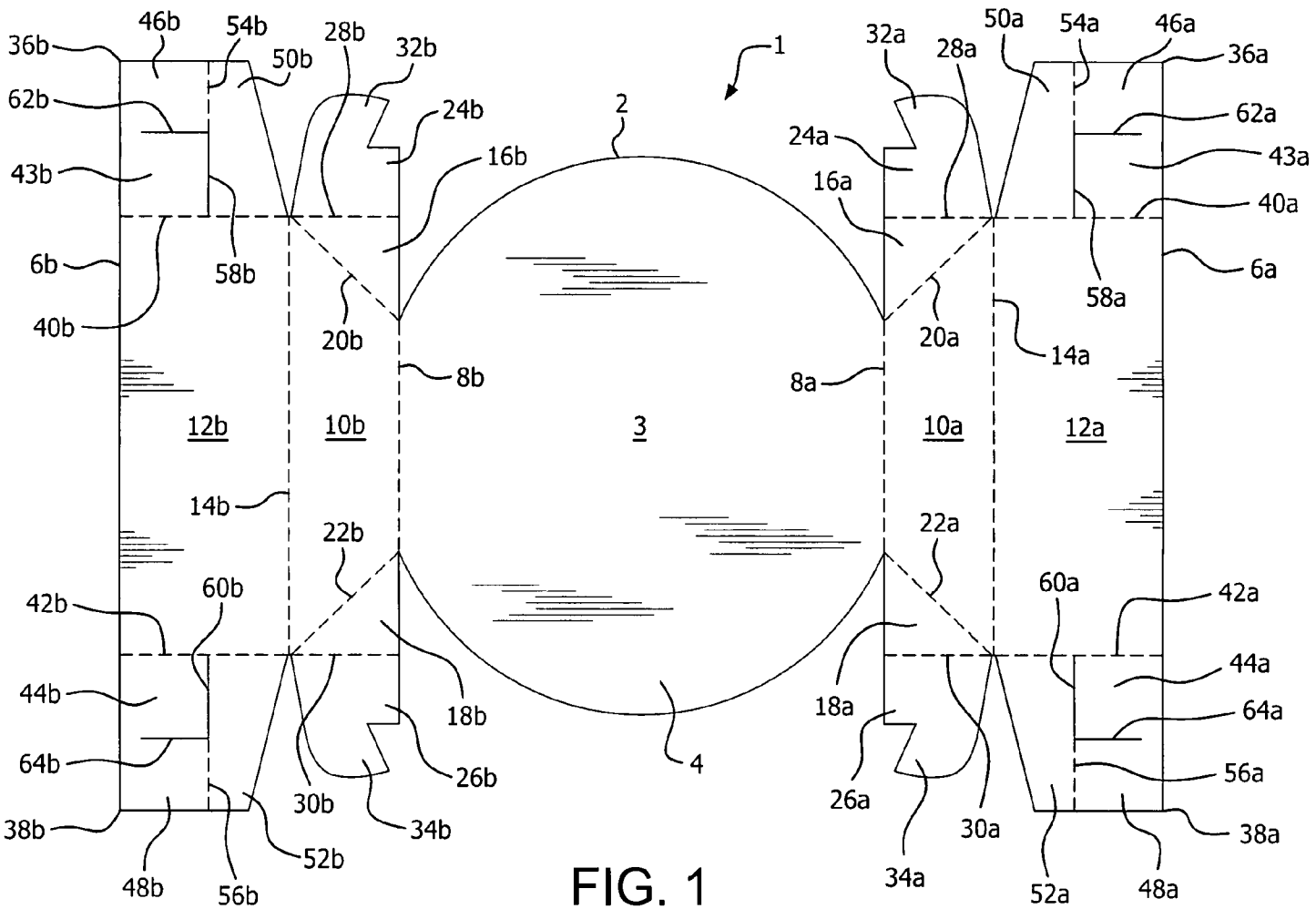
FIG. 1 is a top view of the inner surface side of the open blank of the food tray of the present invention.

Convertible food tray 1 of the present invention comprises flat blank 2. It is critical that blank 2 be made of a rigid cardboard, or equivalent material, which allows the blank to be folded, but still retain its integrity and rigidity. The type of cardboard commonly utilized for commercial flat pizza boxes is representative of the type of material which is contemplated.

Blank 2 has tray or central section 3 with inner surface 4 and outer surface 5, and wing members 6*a* and 6*b* extending from and connected to the central section at fold lines 8*a* and 8*b*, located between the central section and the wing members. Wing members 6*a* and 6*b* each comprise a plurality of foldable segments, including intermediate support segments 10*a* and 10*b* extending from central section 3 and separated by fold lines 8*a* and 8*b*, and outer support segments 12*a* and 12*b* extending from intermediate segments 10*a* and 10*b* and separated by fold lines 14*a* and 14*b* which are parallel to fold lines 8*a* and 8*b*.

Intermediate support segments 10*a* and 10*b* comprise triangular shaped segments 16*a*/18*a* and 16*b*/18*b* separated by fold lines 20*a*/22*a* and 20*b*/22*b*. End segments 24*a*/26*a* and 24*b*/26*b* extend from triangular segments 16*a*/18*a* and 16*b*/18*b* and are separated by fold lines 28*a*/30*a* and 28*b*/30*b*. End segments 24*a*/26*a* and 24*b*/26*b* each have tab members 32*a*/34*a* and 32*b*/34*b*.

Outer support segments 12*a* and 12*b* comprise lateral segments 36*a*/38*a* and 36*b*/38*b* separated by fold lines 40*a*/42*a* and 40*b*/42*b*. Lateral segments 36*a*/38*a* comprise segments 43*a*/44*a*, 46*a*/48*a*, and 50*a*/52*a*. Segments 43*a*/50*a* and 44*a*/52*a* are separated from outer support segment 12*a* by fold lines 40*a* and 42*a*. Segments 46*a*/50*a* and 48*a*/52*a* are separated by fold lines 54*a*/56*a*. Cut out openings 58*a* and 60*a* extend between segments 43*a*/50*a* and 44*a*/52*a*. Partial cut-out openings 62*a* and 64*a* extend between segments 43*a*/46*a* and 44*a*/48*a*.

Likewise, lateral segments 36*b*/38*b* comprise segments 43*b*/44*b*, 46*b*/48*b*, and 50*b*/52*b*. Segments 43*b*/50*b* and 44*b*/52*b* are separated from outer support segment 12*b* by fold lines 40*b* and 42*b*. Segments 46*b*/50*b* and 48*b*/52*b* are separated by fold lines 54*b*/56*b*. Cut out openings 58*b* and 60*b* extend between segments 43*b*/46*b* and 44*b*/52*b*. Partial cut-out openings 62*b* and 64*b* extend between segments 43*b*/46*b* and 44*b*/48*b*.

Convertible food tray 1 is easily and quickly assembled as follows. Open blank 2 is positioned such it is resting on outer surface 5 of central member 3 as seen in FIG. 1. Wing member 6*a* is first folded down onto inner surface 4 of the central section, at fold line 8*a*. See FIG. 2 which shows wing member 6*b* fully assembled and the assembly of wing member 6*a* in progress. With intermediate support segment 10*a* resting on inner surface 4, outer support segment 12*a* is folded up so that it is upstanding and substantially perpendicular to central section 3. Lateral segments 36*a* and 38*a* are folded at fold lines 40*a* and 42*a* so that they are also upstanding and substantially perpendicular to central section 3. End segments 24*a* and 26*a* are folded up at fold lines 28*a* and 30*a* so they too are substantially perpendicular to central section 3 and outboard of upstanding lateral segments 36*a* and 38*a*. Tab members 32*a* and 34*a* are next inserted through cutout openings 58*a*/60*a* and 62*a*/64*a* to interlock the ends of intermediate support segment 10*a* to outer support segment 12*a*.

The identical assembly process is performed with the segments which comprise wing member 6*b*.

Figure 2:
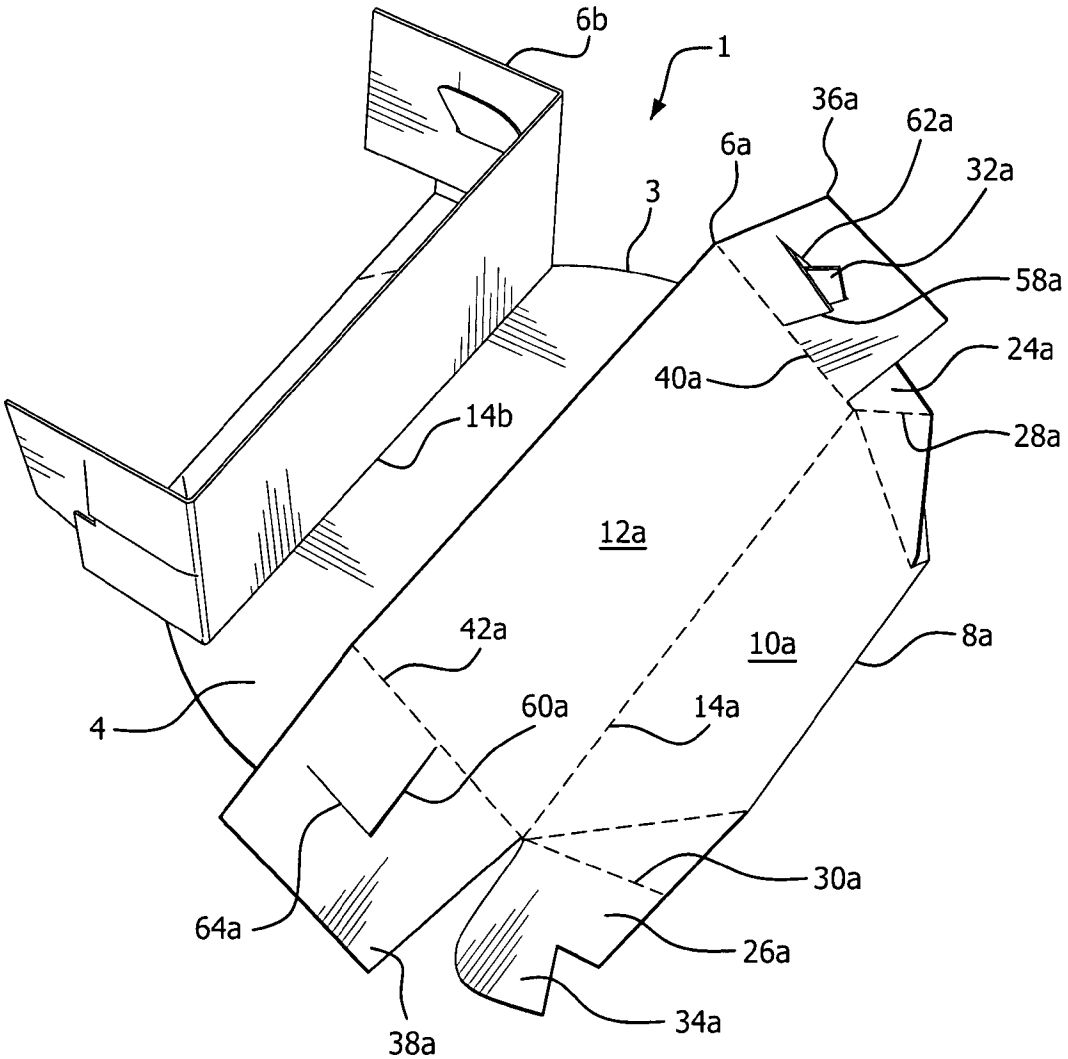
FIG. 2 is a perspective view of the blank of the food tray of the present invention, partially assembled.

When outer support segments 12*a* and 12*b* of wing members 6*a* and 6*b* are folded up at fold lines 14*a* and 14*b*, the wing members are upstanding and substantially perpendicular to central section 3, as seen in FIG. 2.

To place food tray in its fully collapsed position, assembled wing members 6*a* and 6*b* are folded down onto inner surface 4 of central section 3, such that all segments of the wing members lay flat and are substantially parallel to the central section. This is accomplished by folding wing members 6*a* and 6*b* down onto central section 3 via fold lines 14*a* and 14*b* and then folding lateral sections 36*a*/38*a* and 36*b*/38*b* down onto outer support segments 12*a* and 12*b* via fold lines 40*a*/42*a* and 40*b*/42*b*. When fully folded on central section 2, the outboard edges of outer support segments 12*a* and 12*b* of wing members 6*a* and 6*b* almost meet. See FIG. 3.

Figure 3:
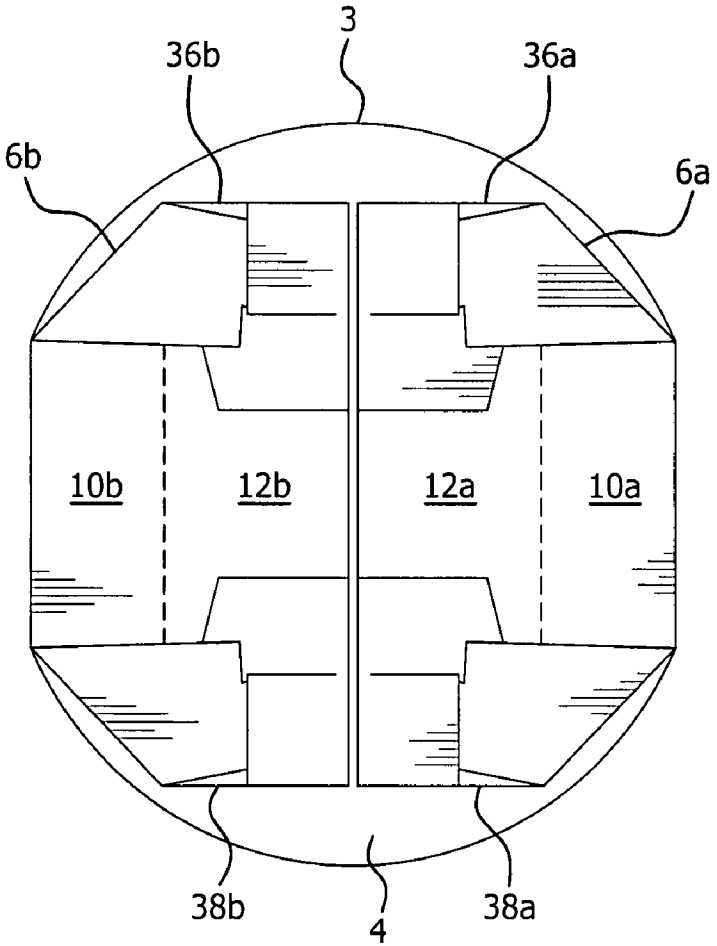
FIG. 3 is a bottom view of the food tray of the present invention in its collapsed position.
Figure 4:
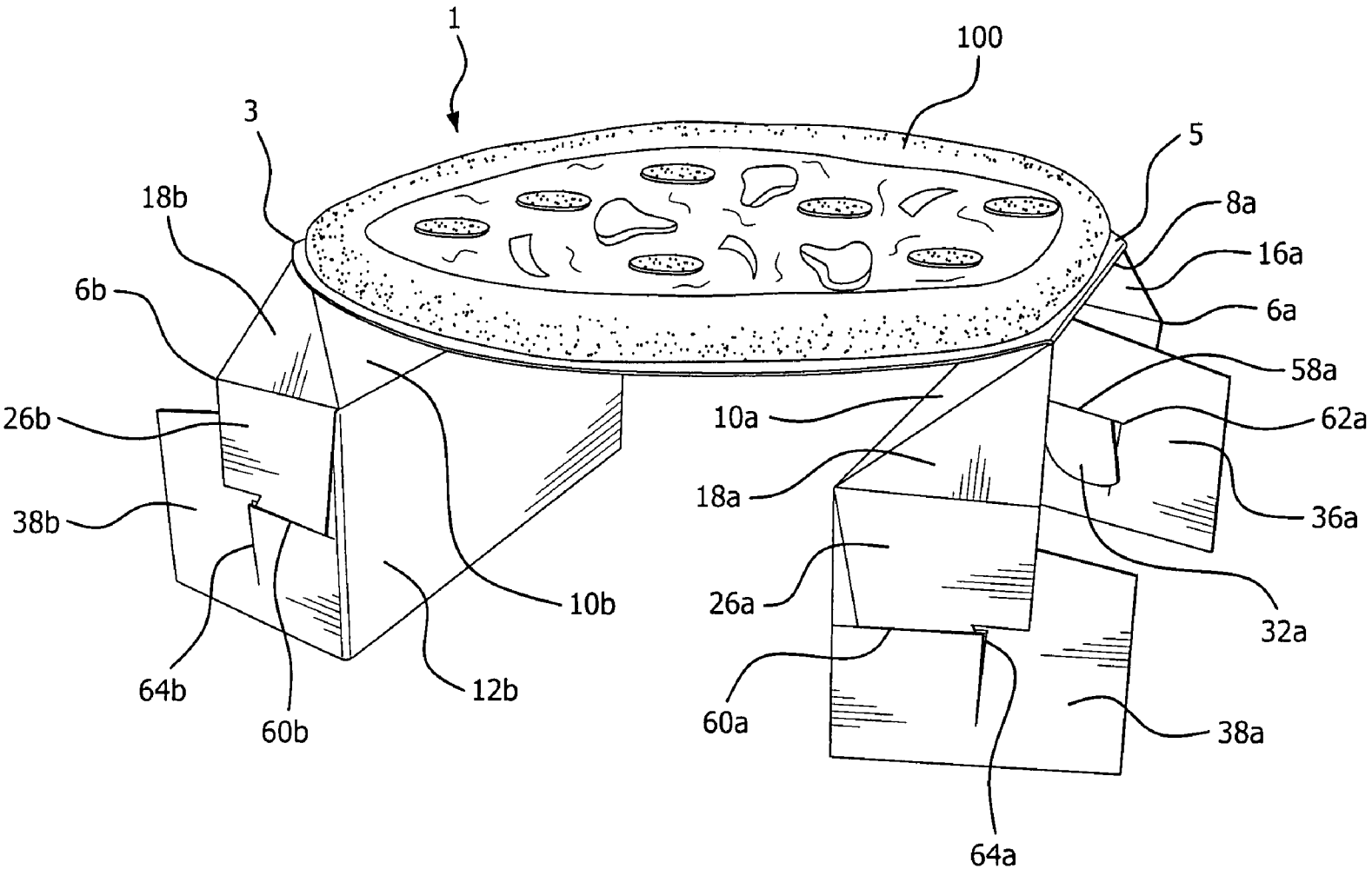
FIG. 4 is a perspective view of the food tray of the present invention supporting a pizza pie before being placed on a table or similar surface.
Figure 5:
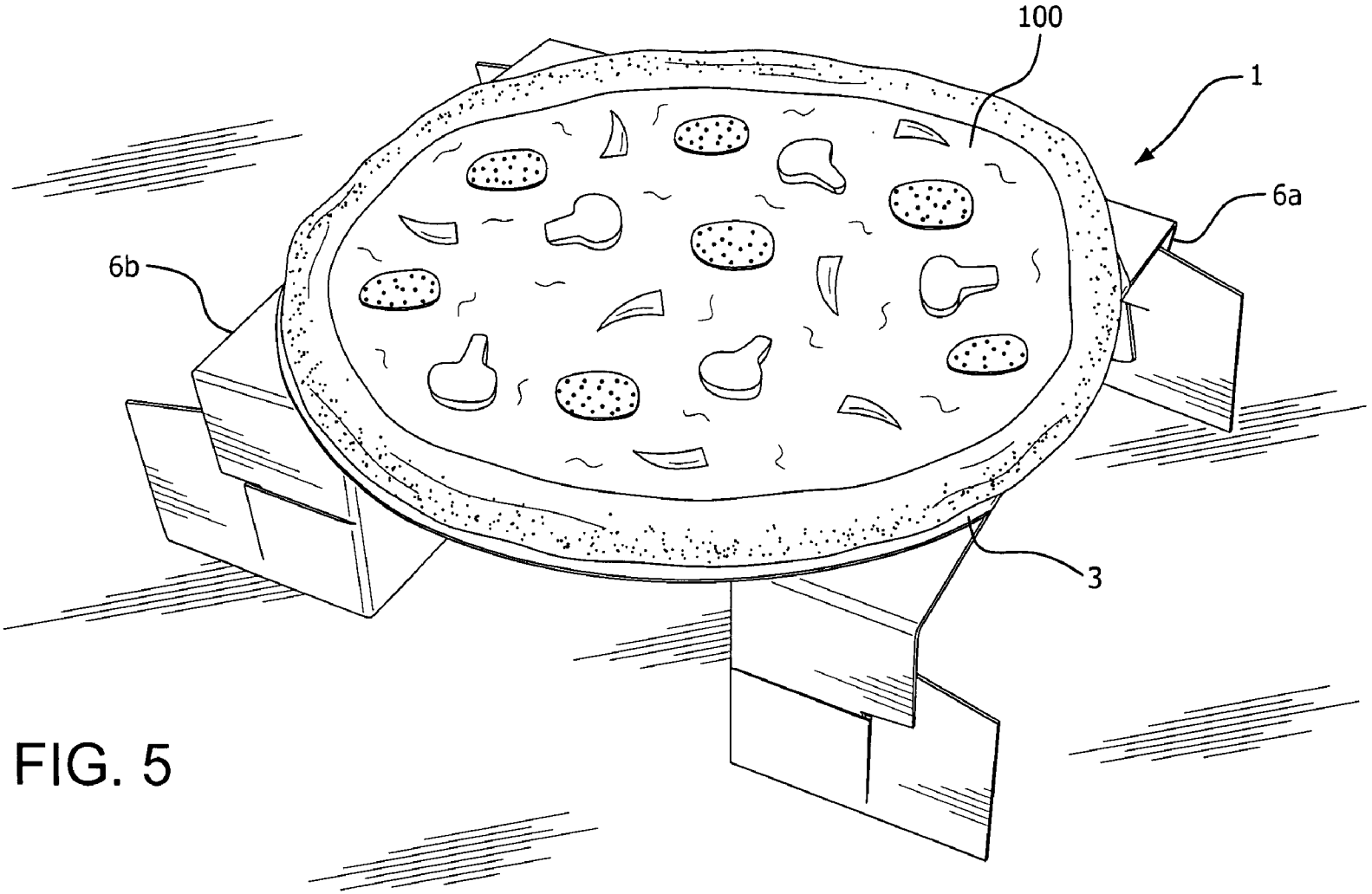
FIG. 5 is a perspective view of the food tray of the present invention supporting a pizza pie on a table or similar surface.

In use, assembled food tray 1 is initially positioned with outer surface 5 of central section 3 facing up and assembled wing members 6*a* and 6*b* folded flat beneath the central section in collapsed position as shown in FIG. 3. A pizza pie 100, or like food, is placed on outer surface 5 of central section 3. Especially with the weight of pizza 100 thereon, food tray 1 remains in its collapsed, folded position. Food tray 1, with pizza 100 thereon, is then lifted to allow wing members 6*a* and 6*b* to swing down and out from below central section 3 and thus to be repositioned downward from the central section as tray leg support members. See FIG. 4. When food tray 1, with wing support members 6*a* and 6*b* extended downward, is placed down on a table or other surface, the weight of pizza 100 pushes central section 3 down, which in turn forces down intermediate support sections 10*a* and 10*b* and triangular shaped segments 16*a*/18*a* and 16*b*/18*b*, via fold lines 8*a*/8*b*, 20*a*/28*a*, 22*a*/30*a*, 20*b*/28*b* and 22*b*/30*b*. This compels wing support members 6*a* and 6*b* inward and substantially perpendicular to central section 3, thereby providing the requisite support to maintain food tray 1, with pizza 100 thereon, in a stable, elevated position. See FIG. 5.

After pizza 100 is consumed, food tray 1 can be disposed of or, if it is needed for reuse, wing support members 6*a* and 6*b* can simply be refolded and collapsed beneath central section 3 once again.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A symmetrical one piece flat blank for a convertible food tray comprising:

a flat central section having a given dimensional width, two diametrically opposite lateral sides, a top edge and a bottom edge, a flat first wing section attached to and extending from one lateral side of the central section, a fold line between the two sections, a flat second wing section identical to the first wing section extending from the second lateral side of the central section, and a second fold line between the second wing section and the central section, each of the wing sections having a dimensional width of approximately one-half the dimensional width of the central section, the wing sections attached to the lateral sides of the central section comprising the only attachments of the blank which extend from the central section, the central section having nothing attached to its top and bottom edges, each wing section further comprising an intermediate support section, and an outer support section of equal dimensional lengths, a wing fold line parallel to the first and second fold lines extending the full lengths of and between the intermediate support sections and the outer support sections, foldable segments at the ends of both the intermediate and outer support sections, and segment fold lines between the foldable segments and the intermediate and outer support sections, the segment fold lines extending the entire width of the wing sections and perpendicular to the wing fold lines.

2. The blank for a convertible food tray as in claim 1 further comprising means at the ends of the intermediate support sections and the outer support sections of the wing sections for interconnecting the segments of said intermediate support sections to the segments of the outer support sections of the wing sections.

3. The blank as in claim 1 wherein blank consists of a rigid cardboard material.

4. A food tray for supporting food, said food tray being convertible between a collapsed food supporting position and an erect food elevating position and comprising:

a central section having a given dimensional width and inner and outer surfaces, a first wing section attached to and extending from one side of the central section and a second wing section attached to and extending from the diametrically opposite side of the central section, the wing sections comprising the only attachments of the tray which extend from the central section, each of the wing sections further comprising an intermediate support section and an outer support section of equal dimensional lengths, a wing fold line extending the full lengths of and between the intermediate and outer support sections, foldable segments at the ends of both the intermediate and the outer support sections, and segment fold lines between the foldable segments and the intermediate support sections and outer support sections, the segment fold lines extending the entire width of the wing sections and perpendicular to the wing fold lines, the support sections and foldable segments of the wing sections being configured to be folded such that they are layered on top of the inner surface of the central section when the tray is in the collapsed position, at least one pair of said foldable segments in each wing section comprising interlocking segments, whereby the food tray is in the collapsed position to support food on the outer surface of the central section when each wing section is folded flat and is layered on top of the inner surface of the central section such that the wing sections are substantially parallel to the central section, the weight of the food on the outer surface of the central section maintains the food tray in said collapsed position, and upon the food tray with the food on the central section being lifted from the collapsed position, the wing sections are caused to swing down and out from below the central section to a position substantially perpendicular to the central section to elevate the food tray to the erect position and the central section to a dimensional height equivalent to the dimensional widths of the outer support sections and at least one-third the dimensional width of the central section.

5. The food tray as in claim 4 wherein segments of the intermediate support section and the outer support section of each wing member interlock at the ends of said sections.

6. The food tray as in claim 4 wherein when the tray is in the collapsed position, the intermediate support sections and outer support sections of each wing section lay substantially parallel to each other, and when the food tray is in the erect position, the intermediate support section of each wing section is substantially perpendicular to the outer support section of its respective wing member.

7. The food tray as in claim 4 wherein the central section and both wing sections are made of rigid cardboard material.

* * * * *